United States Patent [19]

Sheppard

[11] Patent Number: 4,718,727

[45] Date of Patent: Jan. 12, 1988

[54] REVERSIBLE SEAT CUSHION AND BACKREST

[76] Inventor: Michael B. Sheppard, 1031 Redondo Blvd., Los Angeles, Calif. 90019

[21] Appl. No.: 615,122

[22] Filed: May 29, 1984

[51] Int. Cl.[4] ..... A47C 7/02

[52] U.S. Cl. ..... 297/458; 297/459; 5/481

[58] Field of Search ..... 297/458, 459, 460, 284, 297/283, 188, 230, 229; 5/481

[56] References Cited

U.S. PATENT DOCUMENTS

| | | | |
|---|---|---|---|
| 185,477 | 6/1959 | Wuollett | 297/459 X |
| 1,450,283 | 4/1923 | Galizia | 297/283 |
| 2,156,629 | 5/1939 | Hutchison | 297/459 |
| 2,384,713 | 9/1945 | Varma | 297/458 |
| 2,855,986 | 10/1958 | Engelen | 297/459 X |
| 2,875,819 | 3/1959 | Hoag | 297/458 X |
| 2,970,638 | 2/1961 | Halter | 297/458 X |
| 3,000,020 | 9/1961 | Lombard et al. | 297/458 X |
| 3,138,404 | 6/1964 | Newton | 297/458 |
| 3,145,054 | 8/1964 | Sopko | 297/460 |
| 3,205,010 | 9/1965 | Schick | 297/458 |
| 3,503,649 | 3/1970 | Johnson | 297/458 X |
| 3,749,442 | 7/1973 | Berg et al. | 297/458 X |
| 4,189,182 | 2/1980 | Rhoe | 297/460 |

FOREIGN PATENT DOCUMENTS

| | | | |
|---|---|---|---|
| 560295 | 3/1944 | United Kingdom | 297/458 |
| 954753 | 4/1964 | United Kingdom | 297/458 |

*Primary Examiner*—Kenneth J. Dorner
*Assistant Examiner*—Laurie K. Cranmer

[57] ABSTRACT

A reversible seat supplement, or seat cushion and/or backrest, includes upper and lower portions which are both contoured, generally concave on one side and convex on the other side; and a keyhole shaped opening including an enlarged opening toward the rear at the base of the spine and the coccyx, and a narrow slot for the anal and urogenital triangle region extending forward to a point more than half way across the seat. Wedge shaped openings angling forward and outward from the central portion of the seat avoid pressure on the sciatic nerves. An optional front vertical opening may be provided to receive a container for a cup of coffee or the like. Bulky material from the seat or the backrest prevent the backrest from flopping forward onto the seat, thus limiting normal folding of the seat back to about 90 degrees from the horizontal seat/pad. The seat back has optional devices to adjust the lumbar pressure. The seat and back portions have a device for alternately combining the reverse sides of the opposite portions to achieve a more personally sizable unit, with the option to use either portion separately as singular reversible unit.

2 Claims, 15 Drawing Figures

REVERSIBLE SEAT CUSHION AND BACKREST

FIELD OF THE INVENTION

This invention relates to seat pads and seat backs, employed either as the basic resilient cushioning on a rigid frame, or preferably as a seat supplement to be used over an existing seat.

BACKGROUND OF THE INVENTION

Various seat pads and cushions have been proposed heretofore, but they have generally been relatively simple, and not susceptible of general usage. Further, while prior seat pads or backrests have been helpful to some persons with specific types of bodily configurations, they would often be uncomfortable for other persons, with different builds.

Accordingly, a principal object of the present invention is to provide a general purpose seat pad and backrest which will provide increased comfort for many persons of different builds, with and without specific health or physical problems, and also for persons who are more or less uncomfortable using normal seats and/or backrests.

SUMMARY OF THE INVENTION

In accordance with one broad aspect of the invention a combined seat cushion and backrest is provided, wherein both the seat and backrest are concave on one side and convex on the other side.

In practice, heavier and larger persons find increased comfort with the concave side of the seat turned up and the flatter or somewhat convex side of the seat back engaging the user's back; while thinner, lighter weight persons find the reverse side of the unit more comfortable with the convex side of the seat facing up. The lighter weight of such persons does not fully compress the seat pad, and comfortable support is provided to such smaller, lighter weight persons by the slightly concave backrest in combination with the convex seat.

In accordance with another aspect of the invention, the seat is provided with a keyhole shaped opening with an enlarged opening at the area where the seat and the backrest join, to relieve the area of the body near the base of the user's spine or near the coccyx. The remainder of the keyhold opening includes a slot or a relieved area in the seat cushion extending forward from the enlarged rear opening to a point more than halfway toward the front edge of the seat to avoid pressure on the urogenital and anal triangular region.

Other aspects or features of the invention include the following:

(1) Wedge shaped slots or relieved portions of the seat extending forward and outward, to avoid pressure to the sciatic nerves and posterior aspect of the femurs.

(2) Extending forward from the rear of the seat where most of a person's weight is supported, are "floating ischial pads" underlying the upper rear portions of the legs at or near the hip joint.

(3) Bulky material, or the termination of one or more layers, from which the seat supplement may be formed, adjacent the folding point of the seat and backrest to prevent the backrest from flopping forward onto the seat.

(4) An optional opening centrally located toward the front of the seat to receive a drink container receptacle or the like.

(5) Arrangements for selectively varying the thickness or support of the lower back portion of the seat back.

With the configurations as described above, injuries to the coccyx, or operations involving the colon, or the lower portions of the reproductive or digestive systems are allowed to heal, free of pressure from sitting which might otherwise exacerbate the soreness or the injuries. The new seat supplement also provides increased comfort and alternative support arrangements to normal persons of many different shapes and bodily configurations.

It may also be noted that the seat cushion and the backrest portions may be used separately, and with either reversed relative to the other, to accommodate additional individual preferences.

Other objects, features and advantages will become apparent from a consideration of the following detailed description and from the accompanying drawings.

BREIF DESCRIPTION OF THE DRAWINGS

Figure 1:
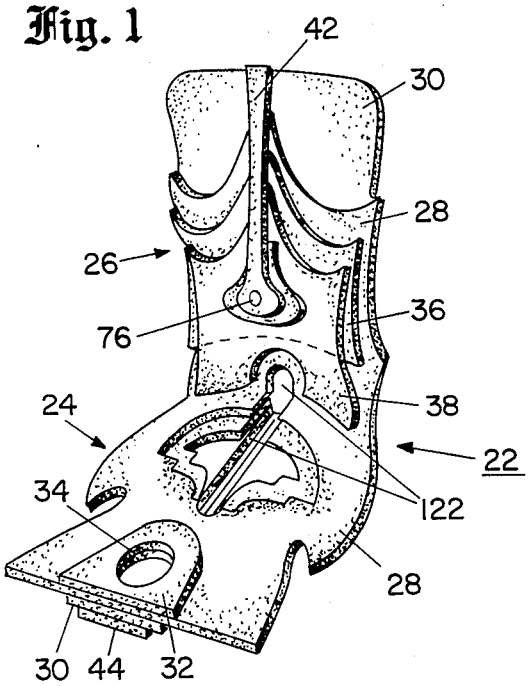
FIGS. 1 and 2 are perspective views of a seat supplement, or combined seat cushion and seat back pad with one side facing the user, and then reversed with the other side ready for use respectively, and illustrating the principles of the invention.
Figure 2:
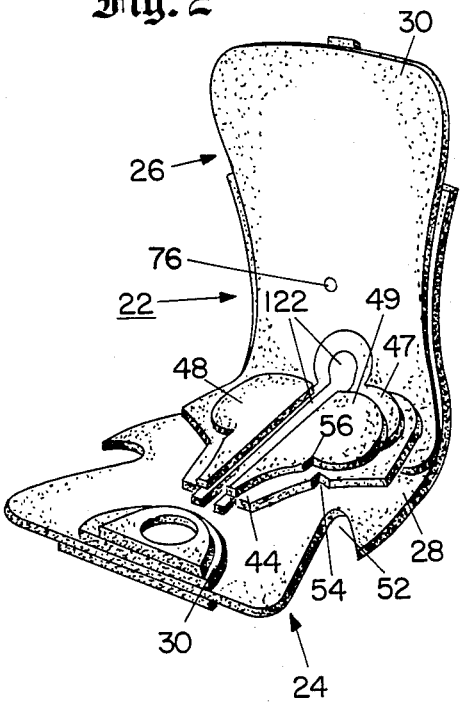
Figure 5:
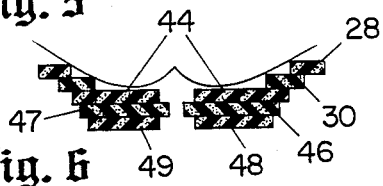
Figure 6:
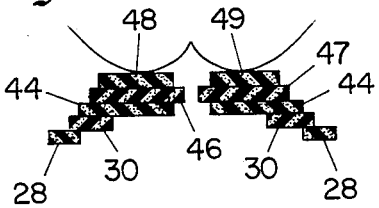
Figure 4:
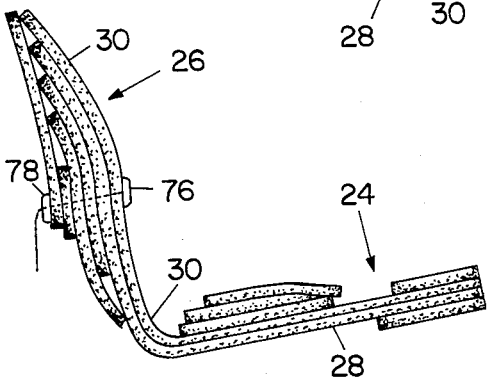
FIGS. 3 and 4 are side views of the seat supplement, with FIG. 3 being a side view of the orientation of FIG. 1, and FIG. 4 being a side view of the reversed orientation, of FIG. 2, in each case with the thickness being exaggerated for clarity.
Figure 7:
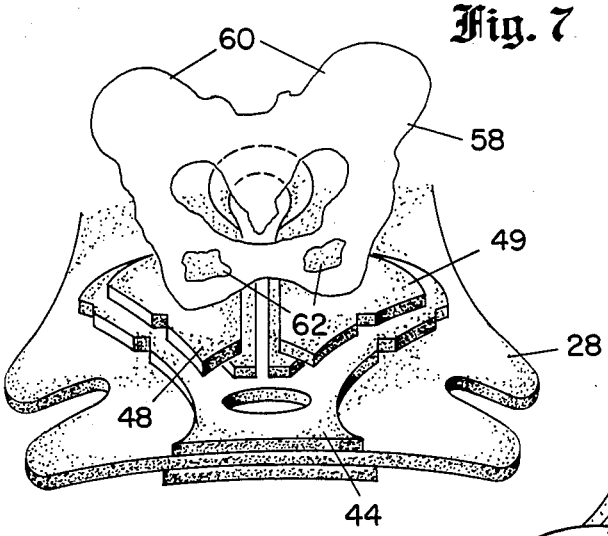
Figure 8:
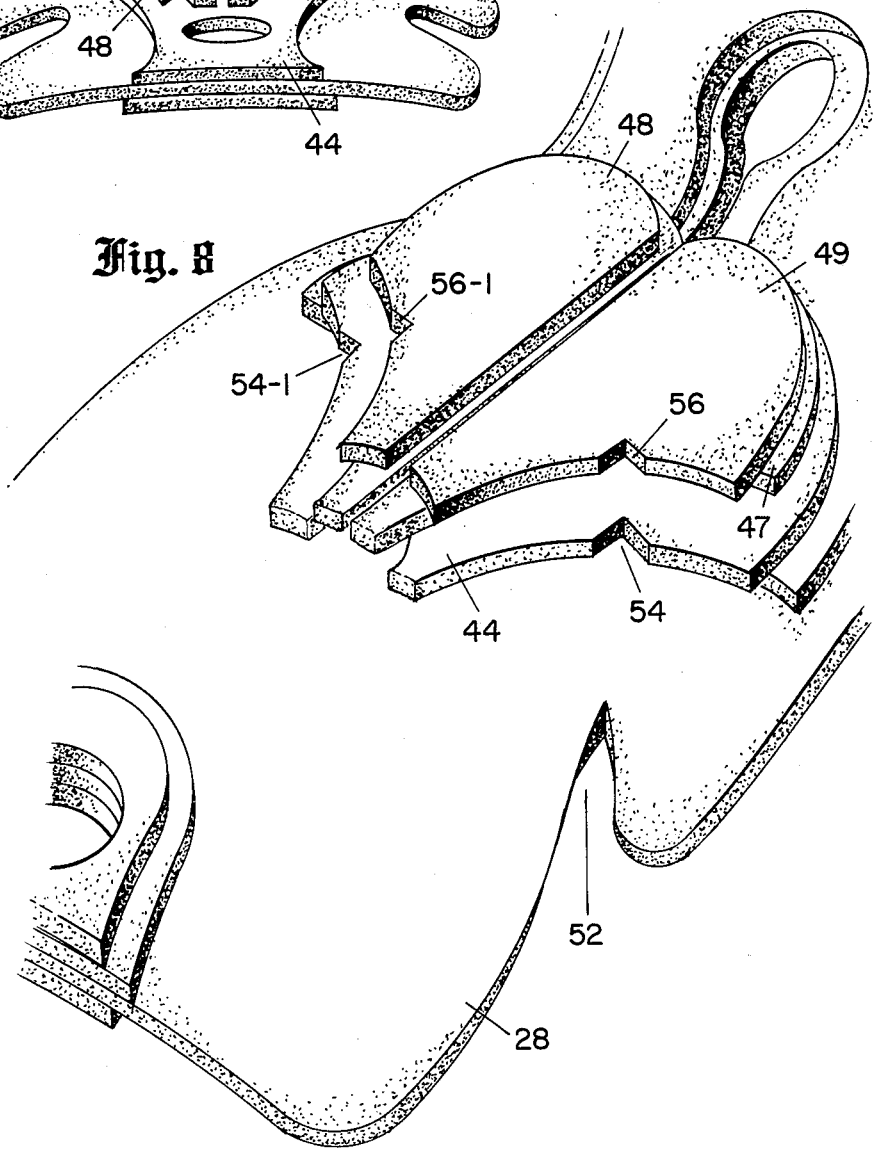
Figure 9:
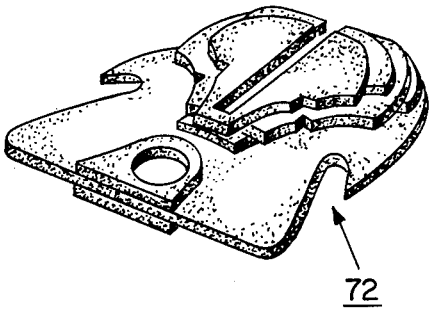
Figure 10:
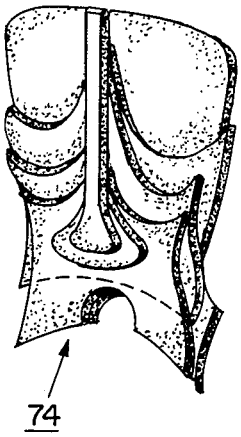

FIG. 5 indicates diagramatically a larger person sitting on the concave seat of FIG. 1;

FIG. 6 indicates a smaller, lighter person sitting the convex seat configuration of FIG. 2;

FIG. 7 indicates schematically a human pelvic girdle bone structure overlying the seat pad and bridging across between the two major spaced resilient areas of the seat pad;

FIG. 8 is an enlarged showing of the seat portion of FIG. 2;

FIGS. 9 and 10 show the seat and back portions as separately usable and separately reversible components fitted with velcro to optionally reverse the seat and/or back portions giving a variation of four sides to select for size preference.

Figure 11:
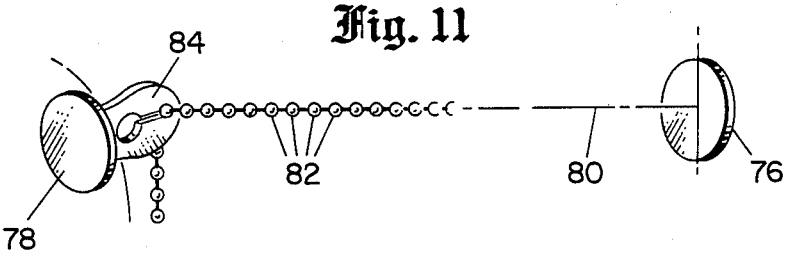
Figure 12:
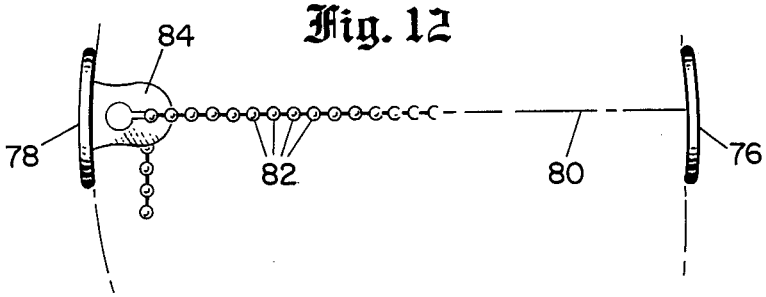
Figure 13:
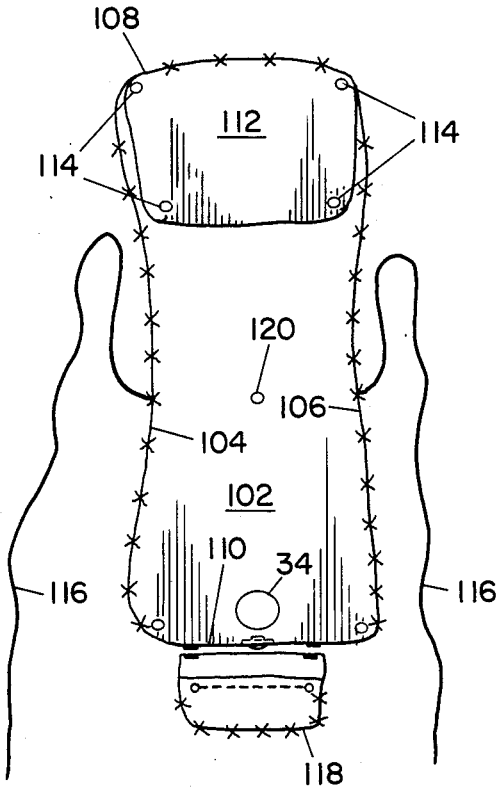
Figure 14:
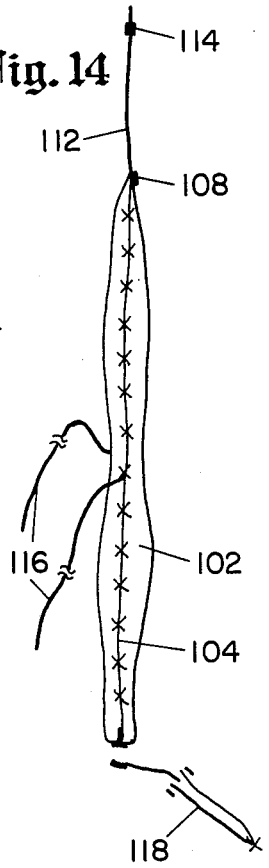
Figure 15:
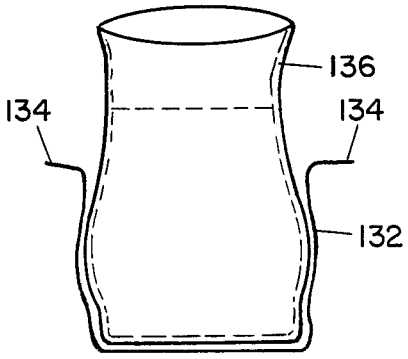

FIGS. 11 and 12 indicate one arrangement for adjusting the thickness of the back pad in the lower back area;

FIGS. 13 and 14 are front and side views of a cover for the seat supplement; and FIG. 15 shows a drink container and cup like receptacle for fitting into the mating opening at the front of the seat portion of the assembly.

DETAILED DESCRIPTION

Referring more particularly to the drawings, the seat cushion and seat back pad (or seat supplement) 22 of FIGS. 1 through 8 of the drawings is formed of an open or closed cell polyurethane foam sheet material specially cut and adhered or cemented together in a layered construction. Instead of being layered, it could be made in a single one-piece molded unit, or in two separate seat pad and backrest molded units as shown in FIGS. 9 and 10.

The seat supplement is reversible, with FIG. 1 showing an orientation with the seat portion 24 being concave or recessed and the back portion 26 being convex or bowing outward. The layers used in the specific illustrative embodiment were about one-half inch in thickness, making a total maximum thickness of about three inches. The thickness is exaggerated in some of the figures such as FIGS. 3 and 4 for increased clarity as to the construction details.

In considering the detailed construction of the assembly, it includes a center panel 28 and another large principal panel 30 which we will designate the convex panel (30). These two panels 28 and 30 are the main panels which extend through most of the length of the seat supplement.

The additional panels or layers which are visible in FIG. 1, which is the concave seat orientation, will now be considered. First, at the front of the seat is the saddle panel 32 with a central opening 34 which also extends through the basic panels 28 and 30. Building up from panel 28 as shown in FIG. 1 are panels 36, 38 and 40, which have been designated the gluteal panel (36), the iliac crest panel (38), and the small sacro-lumbar panel (40). The spinal panel 42 extends from the top of panel 30 down to below the center of the small sacro-lumbar panel 40 or the spinal panel 42 can be optionally removed to alleviate undesirable pressure to the users spinal column. This is another arrangement to adjusting the thickness of the back pad.

Referring now to FIG. 2, on the other side of the main panels 28 and 30, adjacent panel 30 is the basic ischial pad or layer 44. Two additional ischial layers 46–47, and 48–49 overly one-another, and are more clearly shown in FIG. 6. It may be noted that the panel 49 overlies the panel 47 to make for a smoother support for the leg; and panel 48 similarly extends over panel 46. The notches 52, 54 and 56 in panels 28, 44 and 49, respectively, relieve pressure on the sciatic nerve at the back of the upper legs, and this construction is used for both the right and left side of the cushion. This construction is shown in greater detail in FIG. 8, in which the wedge shaped notches 56-1 in panel 48 and 54-1 in panel 44 for the right leg may be noted.

FIG. 7 is a diagramatic showing of a pelvic girdle 58 mounted in proximity to the seat pad, and the illium 60 and ishium 62 are referenced. The terms "illiac" and "ischial" are employed to reference adjacent portions of the seat supplement. The lowermost areas of the pelvic girdle are known as the ischial tuberosities, and are separated from the seat supplement by the gluteus maximus muscles of the buttocks, hence the designation of the lowermost backrest pad 36 (see FIG. 1 as the gluteal layer.

FIG. 9 shows a separate reversible seat pad 72 corresponding substantially to the seat portion as shown in FIG. 2; and FIG. 10 shows a separate reversible back portion 74, corresponding substantially to the showing of the back portion of FIG. 1. These separate seat and back units may be individually covered, and used together or separately, thus providing additional variations and flexibility, designed to provide comfort for all personal preferences and bodily configurations.

It has also been determined that full adjustability of the backrest configuration in the lower back area is desirable; and alternative arrangements for providing variations in thickness and/or compressibility of the backrest portion, as shown in FIGS. 3, 4, 11 and 12. More particularly in FIGS. 4, 11, and 12 two flat button-like compressing members 76 and 78 are provided, and their separation may be adjusted by the tension member 80 having enlargements such as beads 82 which may be secured in the catch 84 to provide the desired thickness of the lower portion of the backrest portion of the unit. The compression element 76 should be flat and tapered at its edges and may be slightly recessed into the backrest so as to avoid localized pressure on the user's back. The two buttons 76 and 78 may be reversed in their positions where the backpad is reversed.

Figure 3:
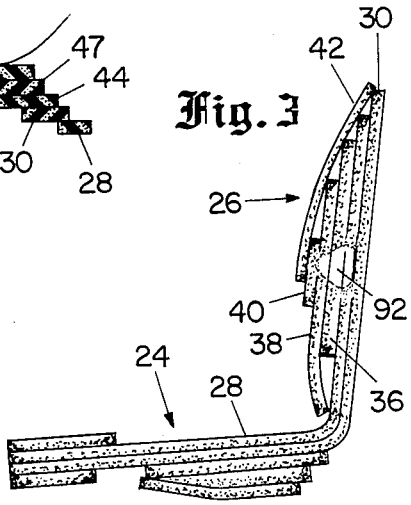

FIG. 3 shows another alternative in which an inflatable member 92 may be located within the backrest portion of the seat supplement. When inflated, the member 92 may be pyramidal or conical, in configuration, or could have a rectangular shape. Balloon-like member 92 may be filled with very light, easily compressible material, if desired, or may be empty. It may be selectively pressurized to any desired inflation pressure, or may be left open to atmospheric pressure. An inflation nozzle and holding arrangements therefor, similar to those found on inflatable plastic pads may be provided.

FIGS. 13 and 14 show a cover 102 for the seat supplement. It is closed along edges 104, 106, and 108, and is provided with snaps along its lower edge 110 to secure the contoured seat supplement inside. An upper flat 112 is provided with grommet holes 114 for securing to the back of a seat by the long elastic straps 116. A storage pocket 118 may be snapped into position along the front edge 110 of the seat. The central snap 120 extends through the central keyhole shaped opening 122 as shown in FIGS. 1 and 2. The cover serves to keep the seat from spreading apart along the extended keyhold slot, and the snap 120 holds the unit in its proper assembled configuration with proper spacing of the keyhold slot, thereby providing the desired central relief of possible pressure for the user.

FIG. 15 shows a receptacle 132 for fitting through the opening 34 in the cover and the seat portion, with the receptacle 132 having an outwardly extending upper lip 134 for bearing on one side or the other of the cover depending on the orientation of the seat supplement. A special container 136 for a beverage may be held in the receptacle 134.

As mentioned earlier in the present specification, the concave side of the seat portion of the seat supplement is usually preferred by bigger, heavier persons, and this is ullustrated by the diagram of FIG. 5. On the other hand, FIG. 6 is a diagramatic showing of a smaller, lighter person sitting on the convex side of the seat portion, with the seat supplement being reversed in its orientation as compared with FIG. 5. It may also be noted that, although the seat will compress somewhat, with the convex orientation of FIG. 6, the fact that the user will tend to be smaller and lighter means that the compression is limited.

For completeness, it is useful to include some of the dimensions of one unit which has actually been built and tested. The over-all length of the unit, when laid out flat is approximately 36 inches, and it is about 18 inches wide. The length of the spined panel 42 was about 13 or 14 inches; the diameter of opening 34 was about 2 ½ to 3 inches; the keyhold slot was about 1/8 inch wide at the narrowest, and pads 48 and 49 (see FIG. 2) are spaced apart by about ½ inch. The larger opening toward the rear of the keyhold slot is about two inches wide.

In conclusion, a preferred embodiment of the invention has been described in the foregoing detailed description and shown in the drawings. It is to be understood, however, that minor variations of these designs may be made by those skilled in the art. Thus, by way of example and not of limitation, the seat supplement may be molded as a one-piece unit, with back and seat being separate; and may have a smooth configuration rather than the stepped configuration shown. Also, the unit may include foamed material of different densities and/or compressibility in different sections of the unit. Also, the seat supplement may be made larger or smaller to accommodate young children or persons with very large builds. Concerning materials, any of the known foamed plastics such as reticulated foam which is used for filter or audio speaker grill mesh, or other resilient materials now used for seat cushions or backrests, or covers therefor, may or may not be employed; and it is contemplated that new fabrics and foam or resilient materials may also be used, such as making it an entirely air inflatable or sealed foam and liquid impregnatable cushion like others previously made for patients in need of such a special cushion. Accordingly, the present invention is not limited to the specific embodiments as shown in the drawings and described hereinabove.

What is claimed is:

1. A reversible seat cushion comprising:

a seat cushion which is concave on one side and convex on the other;

said seat cushion having a central front-to-back relieved area;

said concave side sloping down from both sides to the center, from the front to the center, and also sloping down from the rear of the seat cushion on either side of the median line of the cushion, forward toward the center of the cushion;

the convex side of said cushion also being relieved at the center but being raised on either side of the center, both in the side-to-side direction and in the front-to-back direction;

said seat cushion includes wedge-shaped slot means extending forward and outward from the central rear area of said seat portion to relieve pressure on the sciatic nerves.

2. A reversible seat cushion comprising:

a seat cushion which is concave on one side and convex on the other;

said seat cushion having a central front-to-back relieved area;

said concave side sloping down from both sides to the center, from the front to the center, and also sloping down from the rear of the seat cushion on either side of the median line of the cushion, forward toward the center of the cushion;

the convex side of said cushion also being relieved at the center but being raised on either side of the center, both in the side-to-side direction and in the front-to-back direction; and wherein said cushion is formed of a series of layers of compressible material into one unit of compressible material.

* * * * *